US005257875A

United States Patent [19]

Flanagan

[11] Patent Number: 5,257,875

[45] Date of Patent: Nov. 2, 1993

[54] ONE-WAY SNOWPLOWABLE PAVEMENT MARKER

[75] Inventor: Robert M. Flanagan, Lincolnshire, Ill.

[73] Assignee: Stimsonite Corporation, Niles, Ill.

[21] Appl. No.: 922,628

[22] Filed: Jul. 30, 1992

[51] Int. Cl.[5] ..... E01F 9/06; G08B 0/00

[52] U.S. Cl. ..... 404/14; 404/12; 404/16

[58] Field of Search ..... 404/9–12, 404/14–16

[56] References Cited

U.S. PATENT DOCUMENTS

| | | | |
|---|---|---|---|
| 3,516,337 | 6/1970 | Gubela | 404/9 |
| 3,975,108 | 8/1976 | Suhr et al. | 404/16 |
| 3,980,410 | 9/1976 | Suhr et al. | 404/16 |
| 4,147,447 | 3/1979 | Heenan | 404/16 |
| 4,634,310 | 1/1987 | Clarke | 404/15 |

*Primary Examiner*—Kenneth J. Dorner
*Assistant Examiner*—Nancy P. Connolly
*Attorney, Agent, or Firm*—Jones, Day, Reavis & Pogue

[57] ABSTRACT

A one-way snowplowable pavement marker having an auxiliary ramp at the front of a body portion connecting the spaced first and second primary ramps for supporting a snowplow blade tip when the tip is at angle up to 60° from a line perpendicular to the direction of travel to protect a reflector in the marker. A cast-in-place shelf is formed behind the reflector for supporting the blade tip before and after it leaves the auxiliary ramp to prevent the reflector from being contacted by the snowplow blade.

16 Claims, 1 Drawing Sheet

ONE-WAY SNOWPLOWABLE PAVEMENT MARKER

FIELD OF THE INVENTION

The present invention relates to snowplowable pavement markers in general and specifically to a one-way snowplowable pavement marker having an auxiliary ramp for protecting the reflector when used with snowplow blades set at angles up to 60°.

BACKGROUND OF THE INVENTION

Pavement markers have become widely accepted as permanent installations for providing visible signals which mark traffic lanes and control the flow of traffic on roadways in connection with, or in place of, conventional painted traffic lines. A large number of such markers employ reflectors which retroreflect light emanating from oncoming vehicles to provide a visible signal to the operators of such oncoming vehicles.

A pavement marker of the type depicted in U.S. Pat. No. 4,195,945 and assigned to applicants' assignee, has generally been manufactured in two different versions. The first has a pavement to top of marker height of 0.41 inch high, and is known as a Stimsonite model '96. The second has a pavement to top of marker height of 0.25 inch, and is known as a Stimsonite model '96 LP. The model '96 has an outside ramp angle of 6°, while the model '96LP has an outside ramp angle of 4° . The reduced height of the model '96LP, even though using the same "Model '944" retroreflector, results in approximately 40% of the reflector element being shielded by the road, and thus the retroreflected signal from the 96LP is not as great as the signal from the model '96.

While both models have operated satisfactorily and have been commercially successful, the '96 LP has been utilized in those states where there tends to be either higher speed plowing or much higher traffic volume and its lower height than the model '96 permits less jolting of the operator, particularly during such high speed plow operations as found in expressways in certain parts of the country where there is extremely heavy snowfall conditions.

Exemplary of other snowplowable pavement markers previously known are those disclosed in U.S. Pat. No. 3,790,293 issued to S. A. Heenan et al. on Feb. 5, 1974 and U.S. Pat. No. 3,809,487 issued to R. M. Flanagan on May 7, 1974, both of which are likewise commonly assigned herewith; as well as U.S. Pat. No. 1,952,942 issued to D. E. Ross on Mar. 27, 1934 and U.S. Pat. No. 2,260,498 issued to L. M. Wise on Oct. 28, 1941. Other pavement markers are disclosed in U.S. Pat. Nos. 1,910,791; 1,927,756; 1,952,943; 2,126,224; 2,337,793; 3,332,327; 3,516,337; 3,540,282; 3,587,416; 3,758,191; 3,784,279; 3,975,108 and 3,980,410.

In some areas in which heavier snows occur the plow operators also may tend to adjust the plow blade relative to the longitudinal axis of the roadway, to an angle which may allow the tip of the plow blade to cut away or damage the reflector, or may increase the plow angle such that the plow blade, even though straddling both casting rails or ramps, can drop below the ramps sufficiently to contact the retroreflector and thus damage it. In particular, when the blade angle is greater than 30° with a line perpendicular to the direction of vehicle travel, the blade, and especially the tip of the blade, can enter between the ramps and cause damage to the reflector positioned therein. It is therefore desirable to have a one-way snowplowable pavement marker that will withstand the cutting and abrasive action of snowplow blades set at angles as high as 60° with a line perpendicular to the direction of vehicle travel.

In the '945 patent, snowplowable monodirectional and bidirectional pavement markers are disclosed which include a metal base member having two arcuate-bottom keel members interconnected by an arcuate-bottom support member. The upper surfaces of the keel members respectively define inclined ramps from a plane at one end of the base member toward the other end thereof to corresponding coplanar top surfaces. The support member has a support surface lying below the plane for supporting thereon a retroreflector which is partially recessed below the plane. The keel members and the support member are respectively secured in complementary arcuate recesses with the plane of the retroreflector support surface substantially coplanar with the roadway surface.

In designing these prior art snowplowable pavement markers, it has been a continuing problem to reduce the overall height of the reflector associated with the pavement marker to a minimum level above the roadway surface without undesirable reduction of the retroreflectance of the marker and, accordingly, the visibility of the marker. For example, in attempts to achieve low profile marker designs heretofore, it has been recognized that the angle between the roadway surface and the inclined ramps of the base member should be minimized to reduce the impact of the plow blade on that portion of the housing or casting projecting above the roadway. However, although the ramp angle theoretically could be reduced as low as desired, the lower the angle, the longer the ramp would have to be to maintain the same maximum height and, accordingly, the longer the keel members and the longer the grooves or recesses that would have to be cut in the pavement. The longer the grooves, the greater the time and expense required to form the grooves. Furthermore, the longer the base member, the heavier and more expensive it is. Thus, these factors have served practically to limit to no lower than 6° the outside ramp angle (6.5° inside ramp angle) that could be practically achieved in a prior art bidirectional marker with the full retroreflective area of the existing retroreflectors operatively exposed.

In further attempting to minimize the overall height of the markers above the roadway, it has been suggested in the prior art to further recess the retroreflector elements below the level of the roadway surface. However, in so doing, it has been found that the retroreflectivity and, therefore, the visibility of the marker from a distance can be seriously impaired due to shadowing caused by the lower silhouette of the embedded devices. Partially recessing the reflector elements reduces visibility only if the lowest unshadowed ray from an approaching headlight after refraction at the obverse face strikes the retroreflective element above the lowest point of the cube corner.

Another problem which has been recognized in the design of snowplowable markers is the need to provide devices having improved impact and compression resistance of the retroreflector. In this regard, the development of highly durable devices which would withstand high speed vehicular impact as well as the stress of heavy and frequent plowing has been a primary objective of these devices. A further problem in the design of these products has been the need to provide devices which enable improved tire wiping action to be exerted over the surface of the retroreflector to clean such surface and improve the retroreflectivity thereof without adversely impacting the longevity of the products.

The present invention provides such a one-way snowplowable pavement marker for accommodating snowplow blades set at angles up to 60° with a line perpendicular to the direction of vehicle travel. It has spaced apart primary ramps joined by an arcuatebottom body portion having a front and a rear. A reflector is adhesively mounted toward the rear of the body portion between the primary ramps. An auxiliary ramp is centrally positioned on the front of the body portion between the spaced apart primary ramps to support a snowplow blade when the blade tip is located between the primary ramps. A shelf is formed at the rear of the body portion behind the reflector, the shelf having a height at least equal to the height of the reflector for supporting the snowplow blade tip after it clears the end of the auxiliary ramp with the snowplow blade set at angles up to 60° with a line perpendicular to the direction of vehicle travel. Thus when the tip of the blade first enters the space between the primary ramps, it is supported by the auxiliary ramp. Before the blade leaves the auxiliary ramp it is picked up by the cast-in-place shelf at the rear of the marker thus eliminating contact of the snowplow blade tip with the reflector.

The primary ramps and the auxiliary ramp have a 3.5° ramp angle to reduce ramp blade forces. The primary ramps of the marker casting is fitted with two recesses, one on the interior side of each of the primary ramps. The reflector has a projection on each side and the opposed recesses on the interior side of each of the primary ramps receives a corresponding one of the projections. The projections absorb all shear forces generated by contact of the snowplow blade with the casting so that the adhesive bonding of the reflector to the body portion has to resist only vertical forces.

Further, the novel pavement marker allows wiping and cleaning of the reflector because the distance between the end of the auxiliary ramp and the reflector and the incorporation of a deep radiused pocket therein allows a vehicle tire to touch the reflector as it passes over it, thus wiping and cleaning the reflector. Four bosses support the casting for correct pavement installation. The overall length of the casting is 10 inches so that it can be cast using a Disamatic sand molding machine for high production.

Thus it is an object of the present invention to provide a one-way snowplowable pavement marker for accommodating a snowplow blade set at angles up to 60° with a line perpendicular to the direction of vehicle travel and that will withstand the cutting and abrasive action of snowplow blades set a these angles.

It is also an object of the present invention to provide a one-way snowplowable pavement marker that has an auxiliary ramp positioned between the two primary ramps to support the snowplow blade when the snowplow blade tip enters and is located between the two primary ramps.

It is a further object of the present invention to provide a cast-in-place shelf at the rear of the pavement marker for supporting the blade tip before it clears the end of the auxiliary ramp thereby eliminating contact of the blade tip with the reflector.

It is still another object of the present invention to provide the casting with a recess on the interior of each side of the spaced primary ramps for receiving corresponding projections on the reflector such that the projections absorb all shear forces generated by the snowplowing so that adhesive bonding of the reflector to the casting has to resist only vertical forces which are minimal.

It is also an object of the present invention to provide a pavement marker designed to allow wiping and cleaning of the reflector because of the distance between the end of the auxiliary ramp and the reflector and the incorporation of a deep radiused pocket between the auxiliary ramp and the reflector that allows a vehicle tire to touch the reflector as it passes over it.

It is a further object of the invention to provide a one-way snowplowable pavement marker that incorporates low primary ramp angles of 3.5° to reduce ramp blade forces combined with an auxiliary ramp to allow use of plow blade angles up to 60° with a line perpendicular to the direction of vehicle travel.

SUMMARY OF THE INVENTION

Thus the present invention relates to a one-way snowplowable pavement marker for accommodating a snowplow blade set at angles up to 60° with a line perpendicular to the direction of vehicle travel comprising spaced apart primary ramps, a body portion joining the primary ramps, the body portion having a front and a rear, a reflector adhesively mounted toward the rear of the body portion between the primary ramps and an auxiliary ramp on the front of the body portion between the spaced apart primary ramps to support a snowplow blade when the blade tip is located between the primary ramps so as to eliminate contact of the snowplow blade tip with the reflector.

The invention further comprises a shelf formed at the rear of the body portion behind the reflector and having a height at least equal to the height of the reflector for supporting the snowplow blade tip before it clears the end of the auxiliary ramp to eliminate contact of the snowplow blade tip with the reflector.

BRIEF DESCRIPTION OF THE DRAWINGS

These and other objects of the present invention will be more fully understood in conjunction with the detailed explanation of the accompanying drawings in which like numbers indicate like components and in which.

DETAILED DESCRIPTION OF THE DRAWINGS

Figure 1:
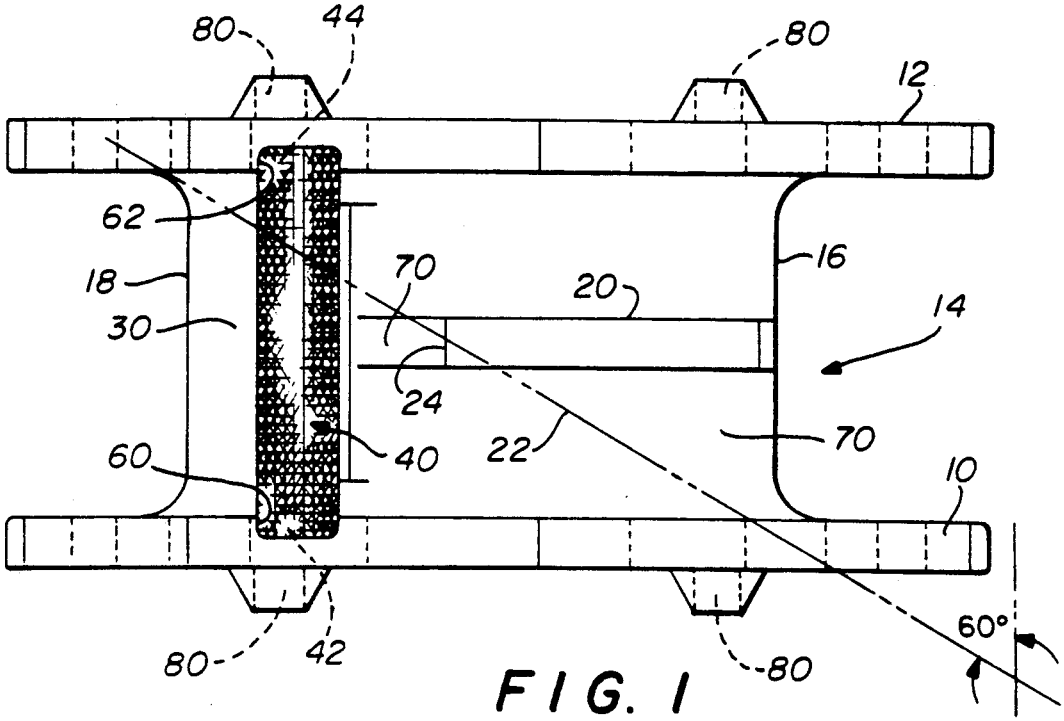
FIG. 1 is a plan view of the novel pavement marker of the present invention.

FIG. 1 is a plan view of the novel pavement marker of the present invention. The marker comprises spaced apart primary ramps 10 and 12 joined by a body portion 14 having a front 16 and a rear 18. An auxiliary ramp 20 is formed on the front 16 of the body portion 14 between the spaced apart primary ramps 10 and 12 and extends longitudinally towards the rear of the body portion. A reflector 40 is adhesively mounted toward the rear of the body portion 14 between the primary ramps 10 and 12. Each of the primary ramps 10 and 12 has on the interior thereof a recess 60 and 62 in opposed relationship with each other for receiving a corresponding one of ends 42 and 44 of each side of the reflector 40. The ends 42 and 44 absorb all shear forces generated by the snowplow blade so that the adhesive 43 bonding the reflector 40 to the body portion 14 has only to resist vertical forces. A cast-in-place shelf 30 is formed at the rear 18 of the body portion 14 behind the reflector 40. The shelf 30 has a height at least equal to the height of the reflector 40 for supporting the snowplow blade before it clears the end of the auxiliary ramp 20 thereby eliminating contact of the snowplow blade tip with the reflector 40.

As can be seen in FIG. with line 22 representing the angle of the snowplow blade at 60° with respect to a line perpendicular to the direction of travel, the tip of the blade will enter the space between the primary ramps 10 and 12 before it contacts the primary ramps 10 and 12. Thus the tip will first contact auxiliary ramp 20 which has a 6° ramp angle sloping upwardly toward the rear 18 of the body portion 14. The blade tip will thus slide up onto auxiliary ramp 20 and then contact primary ramp 10 as illustrated in FIG. 1. Thus the auxiliary ramp 20 keeps the tip of the snowplow blade above the reflector 40. Note the position of line 22 in FIG. 1 which illustrates that the tip of the snowplow blade contacts the shelf 30 before the blade clears the end of the auxiliary ramp 20. Thus the blade is now supported by primary ramp 10 and shelf 30. If can be seen that the blade is maintained above the reflector 40 and therefore eliminates contact of the snowplow blade tip with the reflector 40.

Figure 2:
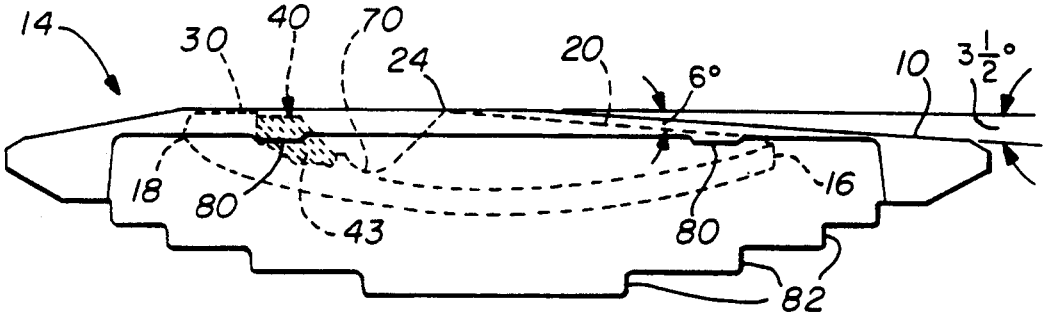
FIG. 2 is a side view of the marker of FIG. 1.

Further, the novel design illustrated in FIG. 1 allows wiping and cleaning of the reflector by vehicle tires that pass over it. The distance between the inner end 24 of the auxiliary ramp 20 and the reflector 40 is approximately 1-3/16 inches and has a deep radiused pocket 70 formed therein as best seen in FIG. 2, both of which allow the tire to touch the reflector as it passes over it. The pocket 70 is approximately ⅝ inch deep. Thus the tires wipe and clean the reflector 40. Four bosses 80 support the casting primary ramps 10 and 12 for correct pavement installation. The overall length of the casting is 10" so that it can be cast using a Disamatic sand molding machine for high production.

Thus as shown, the design in FIG. 1 incorporates primary ramps 10 and 12 with preferred ramp angles of 3.5° and auxiliary ramp 20 with a 6° ramp angle to reduce ramp blade forces. The auxiliary ramp 20 supports the plow blade when the blade tip is located between the two primary ramps 10 and 12 as the blade enters between the ramps 10 and 12. A cast-in-place shelf 30 supports the blade tip just before and after it clears the end of the auxiliary ramp 20 thereby eliminating contact with the reflector 40. The two recesses 60, one in the interior side of each of the primary ramps 10 and 12 in opposed relationship receive ends 42 and 44 on the reflector 40 as shown. As stated earlier, these ends 42 and 44 absorb all shear forces generated by plowing so that the adhesive 43 which bonds the reflector 40 to the casting has to resist only vertical forces which are minimal.

FIG. 2 is a side view of the novel pavement marker illustrating the deep radiused pocket 70 between the interior end 24 of the auxiliary ramp 20 and the sloping front surface of the reflector 40.

Figure 3:
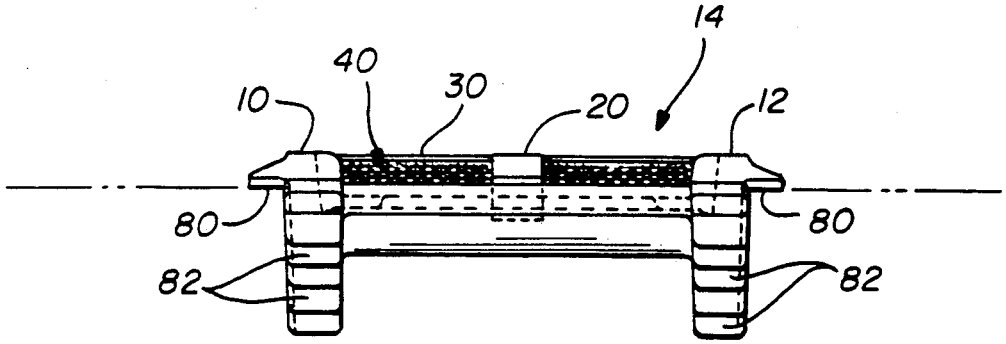
FIG. 3 is an end view of the novel marker of the present invention.

The auxiliary ramp 20 is shown in FIG. 3 in the end view as positioned in the center of the body portion 14 between primary ramps 10 and 12. The step design 82 of the base of each of the ramps 10 and 12 is old and well known in the art and is used to support the casting when placed in appropriate grooves in the roadway.

Thus there has been disclosed a novel one-way snowplowable pavement marker that will withstand the cutting and abrasive action of snowplow blades set at angles as high as 60° with a line perpendicular to the direction of vehicle travel. Normally this angle is usually 30° . The cast-in-place shelf is so positioned in distance with respect to the auxiliary ramp 20 that a snowplow blade, at an angle of 60° , will be supported by the shelf 30 before clearing the end of the auxiliary ramp. Further, the recesses in the interior sides of each of the primary ramps in opposed relationship with each other receive the projections on each end of the reflector and support the reflector in the primary ramp castings and such that the projections absorb all shear forces generated by plowing and the adhesive that bonds the reflector to the casting has to resist only vertical forces which are minimal. Again, the deep radiused pocket between the auxiliary ramp and the cast-in-place shelf allows wiping and cleaning of the reflector by a tire that passes over it.

While the invention has been shown and described with respect to a particular embodiment thereof, this is for the purpose of illustration rather than limitation; other variations and modifications of the specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

I claim:

1. A one-way snowplowable pavement marker for accommodating a snowplow blade having a tip at one end thereof, said blade set at angles up to 60° with a line perpendicular to the direction of vehicle travel comprising:

spaced apart primary ramps;

a body portion joining the primary ramp, the body portion having a front and a rear;

a reflector mounted toward the rear of the body portion between the primary ramps;

an auxiliary ramp at the front of the body portion between the spaced apart primary ramp to support a snowplow blade if the blade tip is located between the primary ramps so as to eliminate contact of the snowplow blade tip with the reflector; and a space between the end of the auxiliary ramp and the reflector to allow a tire of an oncoming vehicle to wipe the reflector.

2. A snowplowable pavement marker as in claim 1 wherein the auxiliary ramp has a 6° ramp angle sloping upwardly toward the rear.

3. A one-way snowplowable pavement marker as in claim 2 further comprising a shelf formed at the rear of the body portion behind the reflector and having a height equal to or greater than the height of said reflector for supporting the snowplow blade tip before and after the blade clears the end of the auxiliary ramp thereby eliminating contact of the snowplow blade tip with the reflector.

4. A snowplowable pavement marker as in claim 3 further comprising:

a projection on each side of said reflector; and opposed recesses on the interior side of each of the primary ramps for receiving one of the projections, said projections absorbing all shear forces on the reflector that are generated by the snowplow blade so that the mounting of said reflector to the body portion has to resist only vertical forces.

5. A snowplowable pavement marker as in claim 4 further comprising:

a curved pocket in the body portion between the reflector and the auxiliary ramp; and the distance between the reflector and said auxiliary ramp and the depth of the radiused curved pocket being such that a vehicle tire is able to contact the reflector as it passes over so as to wipe and clean the reflector.

6. A snowplowable pavement marker as in claim 5 further including supports on the outer side of each primary ramp to support the marker for correct pavement installation.

7. A snowplowable pavement marker as in claim 6 wherein the marker has an overall length of 10 inches.

8. A snowplowable roadmarker comprising:

first and second spaced primary ramps separated by a body portion;

an auxiliary ramp on the front of the body portion between the primary ramp;

a shelf on the rear of the body portion; and a reflector on the front of the shelf for reflecting light in the direction of the auxiliary ramp, the distance between the auxiliary ramp and the shelf being such that the snowplow blade tip is supported by the auxiliary ramp when it enters the space between the primary ramps and by the shelf before the blade tip clears the end of the auxiliary ramp, thereby eliminating contact of the blade tip with the reflector.

9. A base member for use in a one-way snowplowable pavement marker including a reflector and for accommodating a snowplow blade having a tip at one end thereof and able to accommodate a plow blade set at angles up to 60° with a line perpendicular to the direction of vehicle travel, said base member comprising:

a pair of spaced apart primary ramps;

a body portion joining the primary ramps, the body portion having a front and a rear;

support means on the body portion for mounting an associated reflector toward the rear of the body portion and between the primary ramps;

an auxiliary ramp at the front of the body portion and between the spaced apart primary ramps to support a snowplow blade if the blade tip is located between the primary ramps so as to eliminate contact of the snowplow blade tip with an associated reflector mounted on said support means; and the end of the auxiliary ramp and the forward portion of the support means being so dimensioned and arranged to provide sufficient space such that a tire of an oncoming vehicle may wipe the front face of an associated reflector positioned on the support means.

10. A base member as in claim 9, wherein the auxiliary ramp has a 6° ramp angle sloping upwardly toward the rear.

11. A base member as in claim 10, further comprising a shelf formed at the rear of the body portion behind the support means and having a height equal to or greater than the height of said support means for supporting the snowplow blade before and after the blade clears the end of the auxiliary ramp, thereby eliminating contact of the snowplow blade tip with the associated reflector.

12. A base member as in claim 11 further comprising:

a projection on each side of said support means; and opposed recesses on the interior side of each of the primary ramps for receiving one of the projections, said projections absorbing all shear forces on the associated reflector that are generated by the snowplow blade so that the associated reflector mounted to the body portion has to resist only vertical forces.

13. A base member as in claim 12 further comprising:

a curved pocket in the body portion between the support means and the auxiliary ramp; and the distance between the support means and said auxiliary ramp and the depth of the curved pocket being such that a vehicle tire is able to contact the associated reflector as it passe over so as to wipe and clean the associated reflector.

14. A base member as in claim 13 further including supports on the outer side of each primary ramp to support the base member at the correct pavement installation.

15. The base member as in claim 14 wherein the base member has an overall length of 10 inches.

16. A base member for a snowplowable pavement marker comprising:

first and second spaced primary ramps separated by a body portion;

an auxiliary ramp on the front of the body portion between the primary ramps;

a shelf on the rear of the body portion; and support means for mounting an associated reflector on the front of the shelf, the distance between the auxiliary ramp and the shelf being such that a tip of an oncoming snowplow blade is supported by said auxiliary ramp if it enters the space between the primary ramps and by the shelf before the blade tip clears the end of the auxiliary ramp, thereby eliminating contact of the blade tip with the associated reflector.

* * * * *